US005584357A

United States Patent [19]

Gugel et al.

[11] Patent Number: 5,584,357

[45] Date of Patent: Dec. 17, 1996

[54] LADDER

[76] Inventors: Leslie H. Gugel; Joyce A. Gugel, both of 161 E. Hampton Way, Jupiter, Fla. 33458

[21] Appl. No.: 367,781

[22] Filed: Dec. 29, 1994

[51] Int. Cl.[6] ..... A47F 5/00

[52] U.S. Cl. ..... 248/238; 248/238

[58] Field of Search ..... 182/129, 141; 248/238, 210; 211/175, 153

[56] References Cited

U.S. PATENT DOCUMENTS

| | | | |
|---|---|---|---|
| 3,139,154 | 6/1964 | Ewald | 182/129 X |
| 4,421,206 | 12/1983 | Kummerlin | 182/129 X |
| 4,713,949 | 12/1987 | Wilcox | 211/153 X |
| 5,123,620 | 6/1992 | Bourne . | |
| 5,191,954 | 3/1993 | Ledford . | |
| 5,259,480 | 11/1993 | Bartnicki et al. . | |
| 5,295,596 | 3/1994 | Squaitieri | 211/175 |
| 5,342,008 | 8/1994 | Kay . | |

*Primary Examiner*—Alvin C. Chin-Shue
*Attorney, Agent, or Firm*—McHale & Slavin, P.A.

[57] ABSTRACT

The instant invention is directed to increasing the safety of ladders and includes an accessory holder for the top of ladders forming a tray which expands in size allowing placement of working materials in the tray. The tray collapses into a size assimilating a conventional ladder top for compact storage. The tray can be raised to various heights and allows the operator to remove the tray in its entirety to carry items to the ladder providing for convenience and safety. An alternative embodiment provides for the use of solid portions in place of a tray allowing smaller ladders such as to be used as saw horses yet provide a means for forming a smaller tray for securement of miscellaneous working materials. The improved ladder employs handles that couple to each side limb of the ladder allowing an operator to grasp the handles while climbing. An electrical socket mounted in a limb provides for a prewired extension along the length of the limb providing an electrical connection near the top portion of the ladder. Biased wheels allow the ladder to be moved without lifting.

13 Claims, 3 Drawing Sheets

LADDER

FIELD OF THE INVENTION

This invention relates to ladders and more particularly to improvement in ladders including a removable ladder top accessory.

BACKGROUND OF THE INVENTION

Ladders are used for performing tasks at an elevated stance. Conventional ladders are based on a collapsible A-frame structure having support rails that hold individual rungs allowing a person to climb up or down the ladder so as to position themselves at various heights. The top portion includes an area for pivoting the ladder support legs. Although not the intended purpose, this area is commonly used to support working materials lessening the need to climb up and down the ladder in order to obtain the necessary tools to perform a task.

While the primary intent of a ladder is to perform work at an elevated position, a problem arises from the lack of working space available to support tools. The top of the ladder may include holes for positioning of working tools such as hammers, screw drivers and electric drills.

A paint tray support platform may also be used to support items but is designed to position a conventional roller paint tray having end hooks. In light of this lack of working area, various prior art devices have been patented in an attempt to address the minimal work area.

U.S. Pat. No. 5,123,620 discloses an accessory container for a ladder that mounts over the top of the ladder. The device is a single piece container that looks like a bucket and effectively provides an area for tools. The problem with the device is the necessity for removing the accessory when not in use, thus defeating the compactness of the conventional ladder.

U.S. Pat. No. 5,191,954 discloses a platform having support brackets that attach directly to the steps of a conventional aluminum ladder. The support structure relies upon the use of the hollow rungs that are spaced apart a predetermined distance so as to allow support of a back piece that also must be stored separately during storage.

U.S. Pat. No. 5,259,480 discloses an actual ladder top modified to accept various tools or hanging devices by use of a multi-function platform. Provisions are made for the device to replace the existing ladder top or attach directly to the existing ladder top.

U.S. Pat. No. 5,342,008 discloses yet another support platform that can be positioned anywhere along the longitudinal length of a ladder. This teaching requires a special shaped ladder having a handle area that extends above the top of the conventional A-frame support.

Thus, the prior art documents that a problem with ladders is the insufficient work area available for support of materials while working on the ladder. This becomes a special problem in holding larger items such as paint cans which have a level of instability. This instability can lead to disastrous results should the paint can tip over while placed on a ladder. For these reasons it would be most beneficial to have a ladder with a broad surface area to support various working materials yet does not require independent storage.

SUMMARY OF THE INVENTION

The instant invention is an accessory for a conventional ladder that operates as an expandable tray for holding miscellaneous items at the top of a ladder. The tray is defined by a two piece section having four sidewalls to contain items within the boundaries of a conventional ladder top. Should additional surface area be necessary to support larger items, the tray can be expanded to increase the effective surface area of the platform.

For instance, when a one gallon can of paint is placed on a conventional ladder top, any movement of the ladder could cause the paint can to fall. By use of the tray of the instant invention, the tray will provide sufficient support to accommodate the pail wherein the sidewalls operate to contain the pail as well as paint spills.

The tray that is formed by the invention is defined by mirror image support platforms having a side wall, two end walls, and a free edge. When the free edge of each section is abutted, a tray is formed. The sections are coupled to the ladder by use of an attachment bracket with rivets allowing each section to slide along the length of the ladder top as defined by a slot positioned in the brackets.

This adjustment allows the tray support to accommodate most every sized article to be used by a worker. For example, should a quart paint can be placed in the tray it would be preferable to leave the tray in a closed position as the sidewalls will provide sufficient support to prevent tippage of the paint. If a one gallon paint can is needed, the sections of the tray can be placed in a semi-open position allowing the sidewalls to provide support to secure the paint in position. The support tray can be further opened holding a large variety of tools. If needed, a five gallon paint can may be placed in the tray for the weight of the can is directly over the A-frame structure providing superior support. Thus, working tools such as drills, hammers, nails, and the like can easily fit into the tray without need of weight management as the sidewalls prevent accidental droppage by directing the weight of the tools over the ladder frame.

In an alternative embodiment to the instant invention, the support tray of the instant invention is set upon an adjustable platform allowing the tray to be elevated over the top of the ladder. The elevation provides additional convenience to the operator should the operator choose to position himself on a higher portion of the ladder. The bracketry allows removal from the ladder by use of a bracket that accommodate both elevation and removal of the tray. As the tray can be positioned about the ladder top, a support platform provides the necessary surface area for support of materials when the tray is placed in an open spaced apart position. The support platform allows the tray to be raised or moved without dropping of smaller items.

It should be noted that the support shelf may open only one side at a time to avoid interfering with a worker who stands along an upper portion of the ladder. The tray may be formed of unequal dimensional aspects wherein one side of the support tray is moved while the remaining portion is in a fixed position further accommodating personal preference.

Another embodiment of the instant invention is to utilize a flat tray for the support shelf in place of a tray with sidewalls. This support platform has particular benefits when used on a stoop ladder allowing the ladder to be used as a saw horse yet still provide an area that opens for holding items therebetween.

The instant invention includes the use of various accessories in addition to the removable ladder top allowing for the safety and convenience of the operator. The improved ladder includes a pre-wired electrical extension connection which allows the bottom of the ladder to be attached to an electrical cord with a pre-wired socket located along an upper portion of the ladder. This allows the operator to plug electric tools directly into the ladder so as to eliminate the need for an extension cord spanning the length of the ladder. Handles are available for placement on each side of the ladder allowing the operator to climb the steps while grasping the handles for safety. When the operator reaches the upper portion of the ladder, the handles on the tray accessory may be held using release grips allowing the tray to be lifted as the operator climbs to a higher step providing stability. Spring loaded wheels are also provided on the rear of the ladder allowing movement of the ladder under a no-load condition.

Thus an objective of the instant invention is to disclose an adjustable tray for placement on top of a conventional ladder wherein the tray can be expanded to accommodate various size articles without fear of weight management by positioning articles directly over the A-frame structure of the ladder.

Still another objective of the instant invention is to provide an adjustable tray that can be raised to various heights and removed from the ladder providing for operator safety and convenience.

Yet still another objective of the instant invention is to disclose the use of a workable block support platform on top of a ladder having the attributes of a vise.

Yet still another objective of the instant invention is to set forth a ladder top having prescribed functionality to eliminate the need for the use of separate attachments or the expenditure of valuable storage space when the ladder is not in use.

Yet still another objective of the instant invention is to disclose a ladder having safety improvements including the use of side mounted handles, an electrical socket which electrically couples the lower portion of a ladder to the upper portion of the ladder so as to prevent reaching of extension cords, and the use of wheels for movement of the ladder while in a unloaded condition.

Other objectives and advantages of this invention will become apparent from the following description taken in conjunction with the accompanying drawings wherein are set forth by way of illustration and example certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is to be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
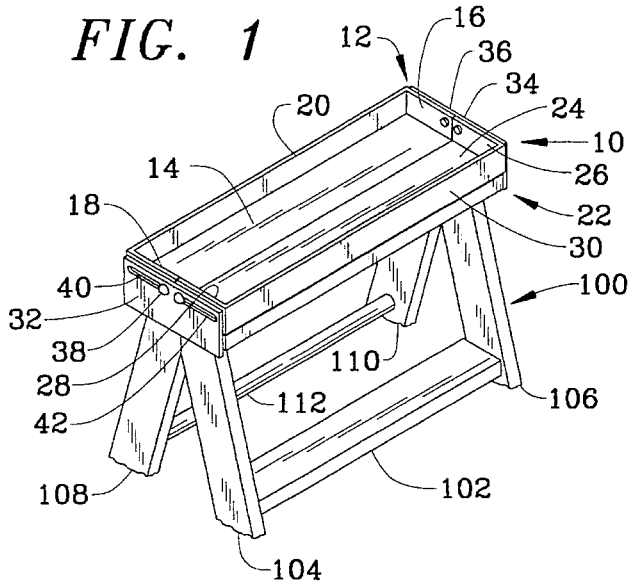
FIG. 1 is a front perspective view of the instant invention mounted on a step ladder.

Now referring to FIG. 1 shown is the instant invention 10 coupled to the top of a conventional ladder 100 having step rungs 102 with spaced apart front legs 104 and 106. The ladder 100 is a conventional A-structure frame having a rear support provided by legs 108 and 110 separated by horizontal support structure 112.

The tray 10, shown in a closed position, is mounted on the top of a ladder 100 having a first side section 12 defined by a base 14 with opposing sidewalls 16 and 18 connected by end wall 20. The base 14 is a rectangular shaped plate having an upper surface and a lower surface. A second side section 22 of the tray is defined as having base 24 with opposing sidewalls 26 and 28 adjoined by end wall 30. The sections form a tray that is held in position by brackets 32 and 34 placed on each side of the ladder 100 by either friction fit plastic tabs, not shown, or by use of screws or bolts positioned through the attachment brackets for coupling directly to the A-frame structure.

Sidewalls 16 and 18 include rivet 36 and 38 associated with slotted aperture 40 depicted on bracket 32 having an adjoining slot on bracket 34. The rivets are slidable along the horizontal length of the slot allowing the first side section 12 to move along the width of the cover. This operates to increase the effective tray width of the device for use in holding larger objects. Similarly, slot 42 is located along a portion of bracket 32 allowing the second side section 22 to slide along a length thereof as defined later in this specification for increasing effective holding capacity of the tray. It should be noted that the slots 40 and 42 on bracket 32 may include rivet locks requiring the first side section 12 and second side section 22 to be lifted in order for the tray to be slid to a particular position. This prevents accidental opening or closing of the tray without manual movement of the rivets in their respective slot.

The tray 10 may be constructed from plastic or metal as the primary support for the tray is the upper portion of the ladder. Thus, the tray requires no support yet maintains the ability to hold heavy objects. Objects placed on the device remain directly over the ladder top wherein the tray extension simply operates to direct the material over the ladder. This allows the tray to be constructed from an inexpensive material allowing low cost production.

Figure 2:
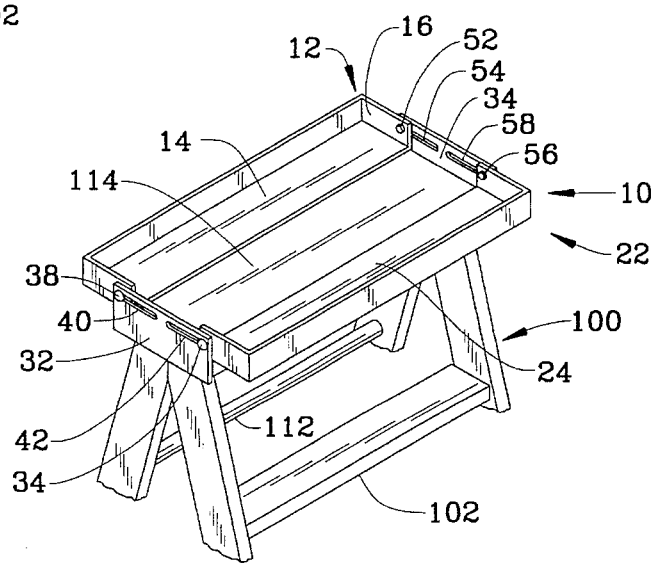
FIG. 2 is a front perspective view of FIG. 1 with the ladder shelf assembly of the instant invention shown in an open position.

Now referring to FIG. 2 shown is the instant invention 10 in an open position wherein first side section 12 and second side section 22 are spaced apart with rivets 36 and 38 extended to the end of slots 40 and 42 of their respective bracket. Similarly, rivet 52 on sidewall 16 is at the end of slot 54 of bracket 34. Rivet 56 is at the end of slot 58 of bracket 34 thereby exposing the cover 114 of the ladder 100. In this position materials can be placed across the cover 114 should the components be excessive in weight. As the bases 14 and 24 are juxtapositioned to the cover 114, items will not fall between the side sections 12 and 22 when placed in an open position. This can further provide an effective seal between the cover and the tray portions to prevent drippage of paint and the like items. It should be noted at this point that side sections 12 and 22 do not have to be made of a similar size as depicted but can be made dissimilar allowing one section of the tray to open completely or larger than the other. This is particularly suitable on smaller ladders having a steeper A-frame structure wherein the rungs 102 would position the operator in an awkward position should the tray be enlarged to a point where it would extend over the rungs 102. In such an embodiment, section 22 may be made small or permanently fixed in position wherein first side section 12 would be enlarged and available to slide out over the unused horizontal support structure 112 allowing the user to have uninhibited room while standing on the ladder rungs 102.

Figure 3:
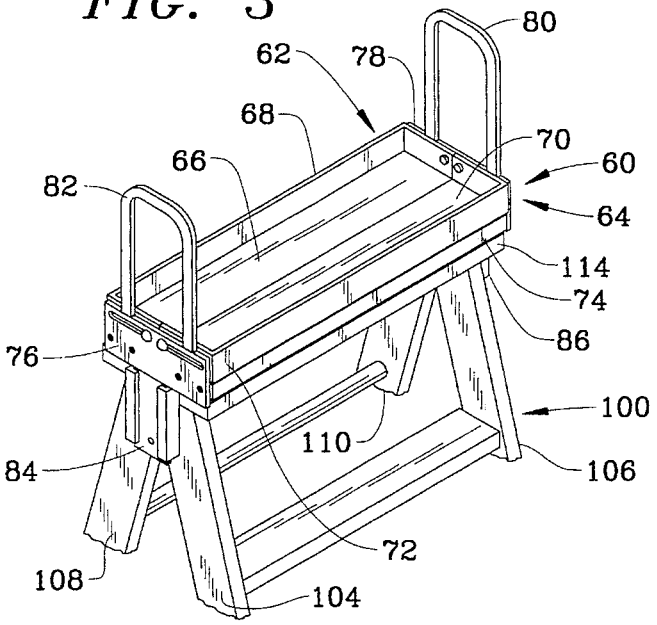
FIG. 3 is a front perspective view of a ladder shelf assembly of the instant invention having a height adjustment bracket.
Figure 4:
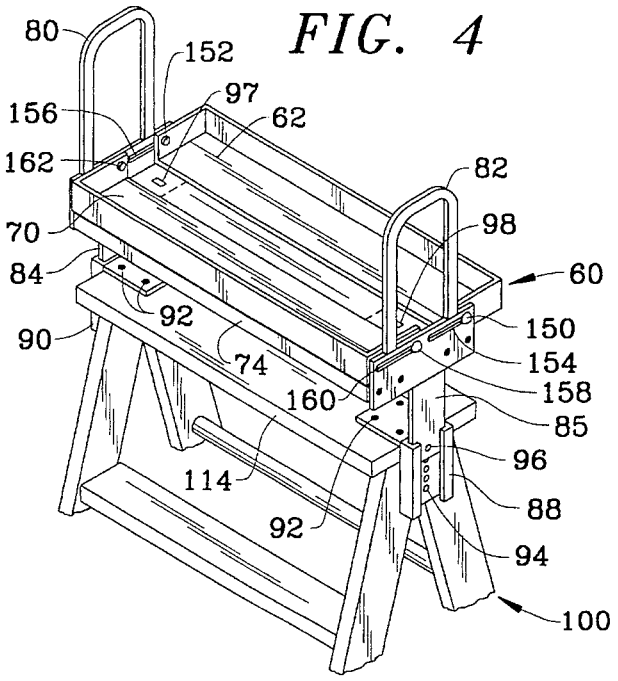
FIG. 4 is a front perspective view of FIG. 3 with the shelf in a raised and open position.
Figure 5:
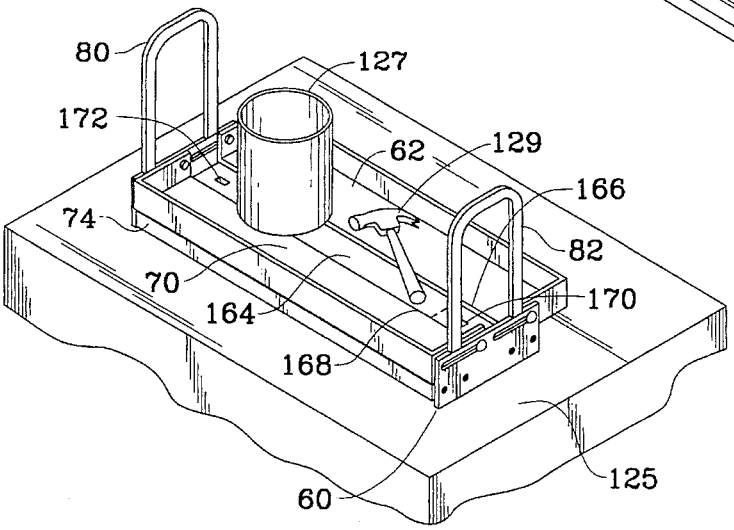
FIG. 5 is a perspective view of the tray removed from the ladder.

Now referring in general to FIGS. 3 through 5, shown is an embodiment of my invention allowing the tray to be raised and removed from the top of the ladder. Ladder 100 is shown with front support legs 104 and 106 coupled to legs 108 and 110 by cover 114 forming the aforementioned A-support structure of a conventional ladder. Tray 60 has a first portion 62 and a second portion 64. The first portion includes a base 66 with continuous sidewall 68 forming three sides in accordance with the aforementioned description. Similarly, second portion 64 has a base 70 with continuous sidewall 72 forming three sidewalls. A separate base plate 74 is provided which is coupled to support brackets 76 and 78 providing support for base 66 and 70 when the tray is removed or raised. By having an individual separate base plate 74 the tray can be removed from the ladder by use of handles 80 and 82 by lifting the tray upward to overcome finger hooks formed in a bracket 84 and 86 beneath separate base plate 74. The tray 60 can be raised to a level as needed for the convenience of the user by lifting brackets 84 and 85 from support slot 88 and 90. Bolts 92 or screws attach the brackets directly to the top surface of the cover 114. This attachment secures brackets 85 and 84 in a fixed position having a perpendicular support structure with a plurality of coupling holes 94 operatively associated with biased spring release button 96 allowing the bracket 85 as well as associate bracket 84 to be raised or lowered in accordance with the user's preference. Support brackets 84 and 85 are right angled and extend from the bottom surface of separate base plate 74 by use of tabs 97 and 98 shown placed through associated apertures in the bottom of the separate base plate 74. The apertures may extend completely through the separate base plate 74 or simply provide a raised coupling of approximately one half inch which prevents the tray 60 from moving the brackets 84 and 85 unless lifted in a vertical position to overcome tabs 97 and 98. This lifting would be performed by grasping handles 80 and 82 thus allowing tray 60 to be lifted from the ladder top and carried down the ladder allowing the worker to fill the tray in accordance with the particular work to be performed. As shown in FIG. 4 first portion 62 is placed in an open position by having rivets 150 and 152 placed at the end of slot 154 and 156 respectively. Base 70 is shown in a closed position with rivet 158 set at the center most position of slot 160 as is rivet 162 set in a center most position of its associated slot, not shown.

Now referring to FIG. 5, shown is the invention 60 removed from the ladder top position and placed on a table 125 wherein various items such as a paint can 127 and hammer 129 are available for placement within the tray 60. As shown by way of illustration, the paint can 127 is positionable upon second portion 164 and base 70 wherein smaller items such as the hammer 129 will not be lost during use or transfer of the tray 60 as the upper surface 164 of separate base plate 74 prevents smaller items from falling through the separated tray portions as defined by free edge 166 of first portion 62 and free edge 168 of the second section 70. As previously mentioned, handles 80 and 82 allow the worker to simply move the device to an appropriate location for addition or removal of components. Apertures 170 and 172 are available for placement of the aforementioned locking tabs 97 and 98 when the tray 60 is placed on the top of the ladder. It should be noted that apertures 170 and 172 may include a locking mechanism so as to prevent unwanted removal of the tray 60 from the top of a ladder 100 which is preferable in instances where the ladder is to be stored, transferred, or the tray is holding valuable cargo.

Figure 6:
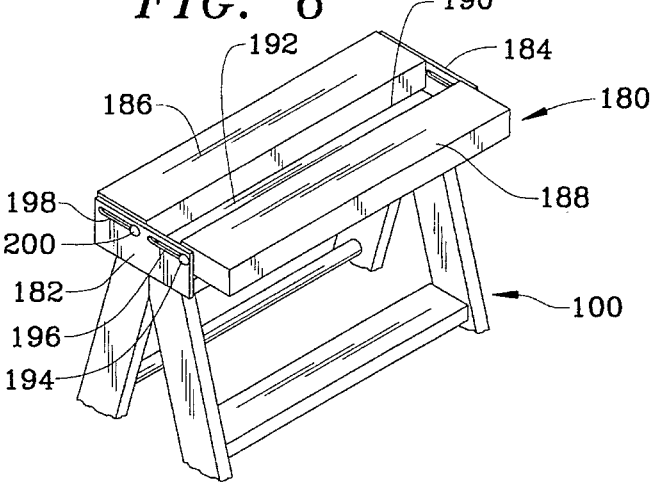
FIG. 6 is a front perspective view of a solid support shelf shown in a semi-open position.

Now referring to FIG. 6, in this embodiment the top of a ladder 100 has a work platform 180 based upon support brackets 182 and 184 coupled to the top of the ladder 100 in a similar manner as previously described. The tray sidewalls are replaced by first section 186 which can be visualized as a conventional and replaceable 2×4 piece of lumber as well as a second section 188 made of similar materials and dimension. First section 186 and second section 188 can be placed in a closed position wherein the ladder can be used in its conventional manner wherein the device is particularly suited for small stoop ladders. The top section may be used as a saw horse support structure. The first and second sections may be slid outward so as to increase the effective working stance of the support as well as provide a center chamber 190 where various items may be placed to prevent their dislodgment from the top of the stoop ladder. As shown by way of illustration, second section 188 is slid outward from support bracket 182 wherein coupling member 194 is slid along slot 196 placing the second section 188 at a distance from first section 186 allowing formation of the center chamber 190 exposing the ladder cover 192 providing sufficient surface area for operation as a saw horse or for holding miscellaneous items between the sections. Similarly, first section 186 may be slid along slot 198 wherein coupling joint 200 allows the section to be moved a predetermined distance before fixation. Not shown by way of illustration is the use of slot and coupling joint on opposing bracket 184 allowing the first and second sections to slide accordingly. It should be noted that placement of a slot along the center of the movable portions will allow the portions to be moved in position by simply rotating of the portions thus allowing the elimination of the slotted brackets yet providing an increased surface area as well as the formation of two different sized cavities depending upon whether one or two sections are rotated into position.

Figure 7:
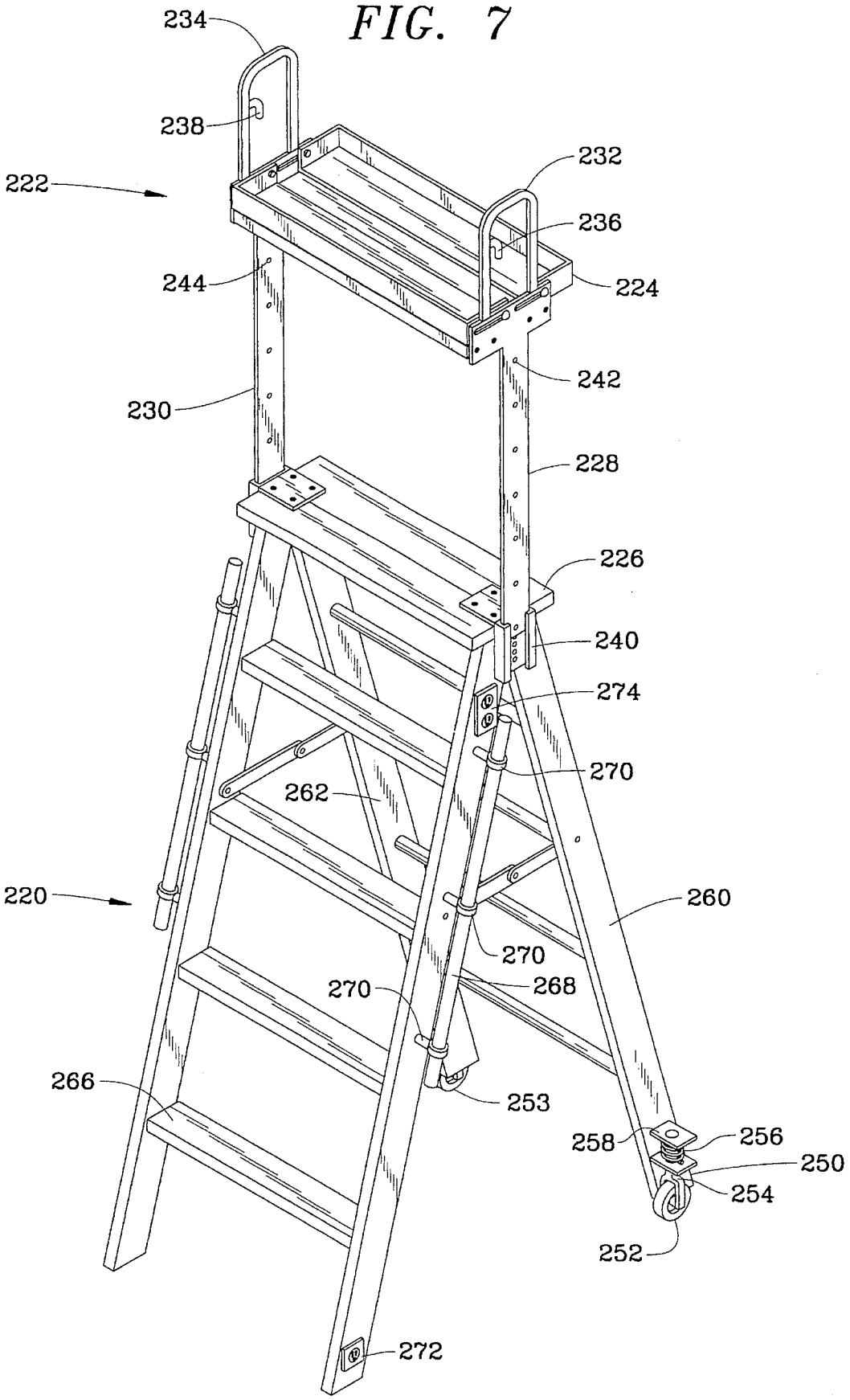
FIG. 7 is a perspective view of a ladder having various accessories of the instant invention attached to the ladder.

Now referring to FIG. 7, shown is a ladder 220 having the accessory tray 222 of the instant invention located along a top portion of the ladder combined with the various accessories of the instant invention to provide a safety ladder. In this illustration, tray 224 is extended above the upper portion 226 of the ladder by use of support brackets 228 and 230 which are sized to extend the tray over two feet above the upper portion 226. Tray handles 232 and 234 include finger release levers 236 and 238 allowing for the slidable insert of support brackets 230 and 228 into support section 240 by depressing of the lever allowing the tray 224 to be lowered one position at a time. A position is determined by releasable locking sections 242 located along the length of support bracket 228 and locking component 244 located along support bracket 230. On the rear of the ladder is located a spring biased wheel 252 and 253. Each wheel has a free wheeling section 250 coupled to a shaft 254 which is biased in a raised position by spring 256 placed within bracket 258. This spring loading allows the wheel mechanism to maintain rear support 260 and 262 in a raised position when no weight is applied to the ladder. When an operator steps on the ladder by use of rungs 266, the weight of the ladder exceeds the biasing of the spring 256 causing the bottom portion of rear supports 260 and 262 to reside firmly along the floor to prevent movement thereof. So as the operator may climb rungs 266 safely, a handle 268 having a reciprocal side support, now shown, on the opposite side of the front portion is coupled a fixed distance from side support 264 by extension brackets 270 allowing the handle 268 to be spaced apart from the side support 264 allowing the operator's fingers to firmly grasp the handle 268 while climbing the ladder.

Receptacle 272 is located along the bottom portion of side support 264 and is electrically connected to a conventional wall type socket 274 along the upper portion of the ladder allowing an individual to plug an extension cord into receptacle 272 energizing the upper socket outlet 274 for operation of power tools without the need for extending electrical cords along the height of the device. The receptacle 272 and socket 274 is electrically coupled by a sealed conduit, now shown, extending the length of the ladder.

In operation, an individual may move the ladder in an unloaded state by tipping the ladder and rolling the back wheels 252 and 253 along a surface for proper positioning. The operator may then plug an electrical cord, not shown, into receptacle 272 so that the socket 274 is available for use. An individual may then climb the rungs 266 of the ladder grasping handle 268 for security. As the operator reaches the top of the platform he may grasp tray handles 232 and 234 raising the tray as he climbs providing stability in height. Socket 274 is then available for plugging in devices without having the operator climbing down the ladder or attempting to use an electrical cord that may need to stretch ten or fifteen feet into the air.

It is to be understood that while I have illustrated and described certain forms of my invention, it is not to be limited to specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. The accessory holder for use in combination with an A-frame ladder comprising:

a support base defined by a two piece plate of nominal thickness placed in a parallel plane forming defining a common upper surface and a lower surface, said upper surface bordered by two side walls creating a first width and two end walls creating a first length forming a tray, said support base further defined as a first section and a second section demarcated along a longitudinal length;

bracket means permanently secured to the top of an A-frame ladder, said bracket means including a means for coupling to said side walls for maintaining said plates in a parallel plane when said plates are moved between said first width and a second width;

wherein said bracket means is coupled to the top of the ladder and said support base secured thereto, wherein said support base forms a tray for placement of work items therein and by movement of said end walls said support base is enlarged forming a larger tray for placement of work items therein.

2. The accessory holder according to claim 1 wherein said first and second sections are equal dimensions.

3. The accessory holder according to claim 1 wherein said bracket means is further defined as two attachment plates permanently attached to each side of the ladder each said plate including a horizontally disposed elongated slot operatively associated with said end walls of each section allowing for the slidable positioning of said sections along a length of said slot.

4. The accessory holder according to claim 1 wherein said bracket means includes a means for elevating said two piece support base above a top portion of the ladder.

5. The accessory holder according to claim 1 including a means for detaching said support base from said bracket means.

6. The accessory holder according to claim 5 including a handle means coupled to said base.

7. The accessory holder according to claim 1 including a plate positioned beneath said first and second sections coupled to said bracket means, said plate providing a floor surface when said first and second section are spaced apart.

8. A ladder having opposing sides, each side having first and second limbs diverging downwardly a top portion thereof, said first limbs paralleling each other and said second limbs paralleling each other, a flight of steps supported between said first limbs, the improvement comprising a rectangular support base having a two piece plate of nominal thickness defining an upper surface and a lower surface, said upper surface bordered by two side walls creating a first width and two end walls forming a first length, said walls having a uniform height forming said base into a tray, said two piece support base divided into a first and second section along a longitudinal length allowing said side walls to be spaced apart up to a second width;

a first and second attachment bracket for coupling said end walls to a ladder top, said attachment bracket having at least one horizontally disposed elongated slot operatively associated with said end walls of each section of said support base allowing for the independent slidable attachment of said sections allowing said side walls to be moved between said first width and said second width;

a support plate having a length equal to said first length and a width equal to said first width, said plate coupled to said attachment bracket providing a surface area when said sections are spaced apart;

means for elevating said support plate a distance above a top portion of the ladder.

9. The ladder according to claim 8 wherein said first and second sections have equal dimensions.

10. The ladder according to claim 8 including a means for locking said support plate to said coupling brackets.

11. The accessory holder according to claim 8 including a handle means coupled to said base, said handle means including a means for releasing said support plate from said coupling brackets.

12. The ladder according to claim 8 including at least one handle coupled to a side surface of at least one of said limbs extending along a longitudinal length thereof, said handle spaced apart from said side surface providing an open area to grasp said handle.

13. The ladder according to claim 8 including at least one electrical connection, said electrical connection defined by a male receptacle permanently secured to a lower portion of a limb and electrically coupled to a female outlet permanently secured to an upper portion of said limb.

* * * * *